US005261133A

United States Patent [19]

Wilkerson

[11] Patent Number: 5,261,133

[45] Date of Patent: Nov. 16, 1993

[54] PREMATURE INFANT POSITIONING DEVICE

[76] Inventor: Sheila Wilkerson, 601 Knight Bridge Rd., Edmond, Okla. 73034

[21] Appl. No.: 906,156

[22] Filed: Jun. 29, 1992

[51] Int. Cl.[5] ..... A61G 7/04; A47C 27/16

[52] U.S. Cl. ..... 5/655; 5/481; 5/901; 5/603

[58] Field of Search ..... 5/603, 630, 632, 633, 5/93.1, 465, 462, 481, 652, 655, 901, 903

[56] References Cited

U.S. PATENT DOCUMENTS

| | | | |
|---|---|---|---|
| 4,566,449 | 1/1986 | Smith | 5/603 X |
| 4,631,766 | 12/1986 | Semmler et al. | 5/655 |
| 4,648,142 | 3/1987 | Bruning | 5/93.1 |
| 4,757,811 | 7/1988 | Clark | 5/603 X |
| 4,825,487 | 5/1989 | Eberl | 5/655 X |
| 5,048,136 | 9/1991 | Popitz | 5/481 X |

*Primary Examiner*—Michael F. Trettel
*Attorney, Agent, or Firm*—Dunlap, Codding & Lee

[57] ABSTRACT

A device constructed of resilient foam material for positioning a prematurely born infant. The device comprises an infant-supporting layer having a head end, a foot end, and an upper surface with a central torso area. A pair of lateral members are attached to the upper surface of the infant-supporting layer to bound the torso area on each side. A transverse member is secured to the upper surface of the infant-supporting layer at the foot end. The upper surface of the infant-supporting layer around the torso area is convoluted to provide air and additional cushion to the head and shoulders of the infant. A foot member is attached on the transverse member between the torso area and the foot end. An infant may be placed in the device in the supine, prone or fetal positions.

6 Claims, 2 Drawing Sheets

PREMATURE INFANT POSITIONING DEVICE

BACKGROUND OF THE INVENTION

1. Field of the Invention

The present invention relates generally to devices for supporting infants and, in particular, to devices for positioning prematurely born babies for travel or for receiving neonatal medical care.

2. Description of Related Art

Various devices have been developed for positioning an infant. Some of these devices are designed for supporting a prematurely born infant, while other positioners are for holding an infant in a required position to combat a disorder or dysfunction affecting the infant.

For example, U.S. Pat. No. 4,516,282 issued to Topalian et al. discloses a device for supporting premature infants while in an incubator. This device is designed to support the back of an infant in several positions, but is suitable only for supporting an infant in the supine position.

Another neonatal infant seat which is suitable only for supporting an infant in the supine position is disclosed by U.S. Pat. No. 4,631,766 issued to Semmler et al. This infant seat is constructed with cavities or hollows to receive the head, back, buttocks and legs of the infant.

U.S. Pat. No. 4,566,449 issued to Smith discloses a positioner which supports an infant with a gastroesophageal reflex disorder in an angled and elevated position. Such an infant may be supported by the positioner in either the prone or supine position.

It is often desirable, however, to position a premature infant in a horizontal prone, supine or side-lying fetal position. In addition, it is frequently necessary to move an infant from one to another of these three positions. The related art does not disclose a device which may be employed for these purposes.

SUMMARY OF THE INVENTION

An infant positioner constructed in accordance with the present invention comprises an infant-supporting layer having a head end, a foot end and an upper surface with a central torso area. A pair of lateral members are attached to the upper surface of the infant-supporting layer. The lateral members are located on opposing sides of the torso area to position the infant upon the upper surface of the infant-supporting layer between the lateral members.

A transverse member is attached to the upper surface of the infant-supporting layer between the torso area and the foot end. The transverse member restricts movement of the infant toward the foot end. A foot member may be attached to the upper surface of the transverse member to support the lower legs and feet of the infant.

The infant-supporting layer, the lateral members, the transverse member and the foot member are all made of a resilient foam material. The upper surface of the infant-supporting layer around the torso area includes a plurality of convolutions. The torso area is recessed with respect to the convoluted area to receive at least a portion of the torso of the infant.

One object of the present invention is to provide a positioner which supports a prone, supine or side-lying infant in the fetal position.

Another object of the present invention is to provide a positioner which facilitates moving an infant between the prone, supine and side-lying positions.

Yet another object of the present invention is to provide an infant positioner which is suitable for use in an isolette of a neonatal intensive care center or a crib in a nursery. The positioner should also be suitable for transporting an infant, particularly for transporting a premature infant by emergency helicopter or ambulance.

Other objects, advantages and features of the present invention are apparent from the following detailed description when read in conjunction with the accompanying drawings and appended claims.

DETAILED DESCRIPTION OF THE PREFERRED EMBODIMENTS

Figure 1:
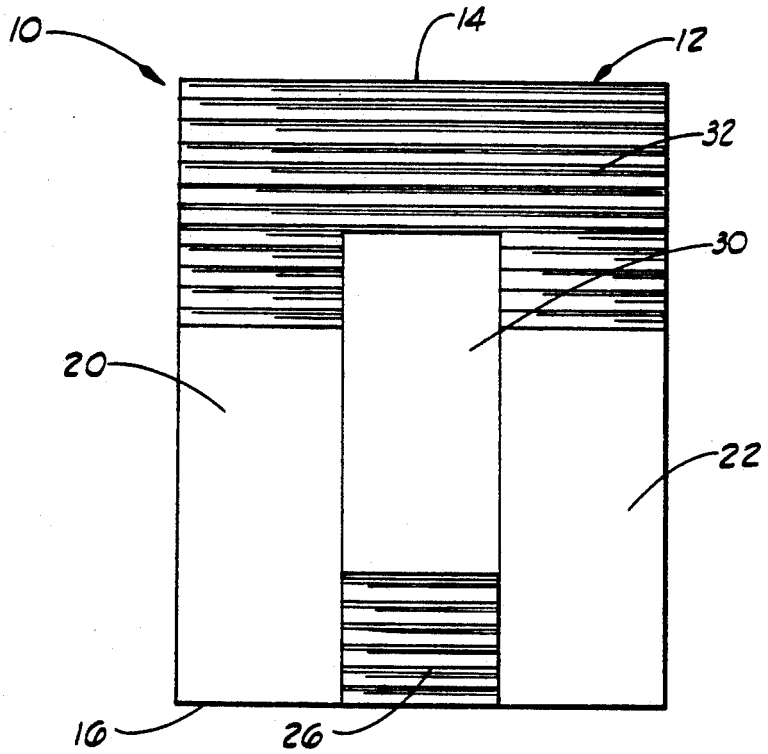
FIG. 1 is plan view of an infant positioner constructed in accordance with the present invention.

Referring to the drawings in detail, reference character 10 generally designates an infant positioner constructed in accordance with the present invention. The infant positioner 10 basically comprises an infant-supporting layer 12 with a head end 14 and a foot end 16, a pair of lateral members 20 and 22, a transverse member 24 and a foot member 26.

Referring to FIG. 1, the infant-supporting layer 12 has an upper surface with a central torso area 30 and a convoluted area 32 around the torso area 30. As shown by the broken lines in FIG. 3, the convolutions of the convoluted area 32 of the infant-supporting layer 12 extend above and around the torso area 30. The torso area 30 thus forms a recessed area for receiving at least a portion of the torso of an infant.

The lateral members 20 and 22 are attached to the upper surface of the infant-supporting layer 12 on opposite sides of the torso area 30. The lateral members 20 and 22 extend from the foot end 16 toward the head end 14 of the infant positioner 10 and border at least half of each side of the torso area 30. The lateral members 20 and 22 restrict lateral movement of an infant placed in the infant positioner 10.

Figure 2:
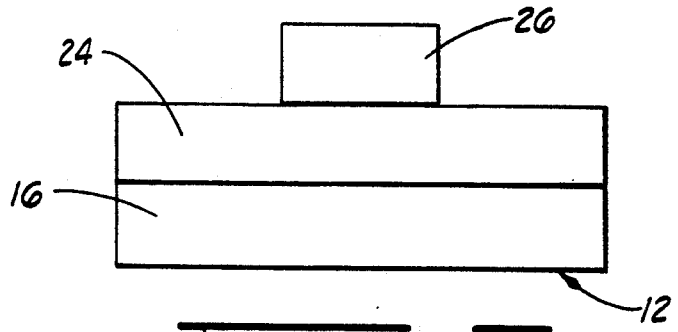
FIG. 2 is a foot end view of the infant positioner of FIG. 1.

Referring now to FIG. 2, the transverse member 24 is attached to the upper surface of the infant-supporting layer 12. The transverse member 24 extends across the foot end 16 of the infant-supporting layer 12 from the torso area 30 to the foot end 16.

The lateral members 20 and 22 cooperate with the transverse member 24 to form a U-shaped infant-positioning member which substantially frames the torso area 30 on three sides. This U-shaped infant-positioning member restricts movement of the infant to the sides and toward the foot end 16.

Figure 3:
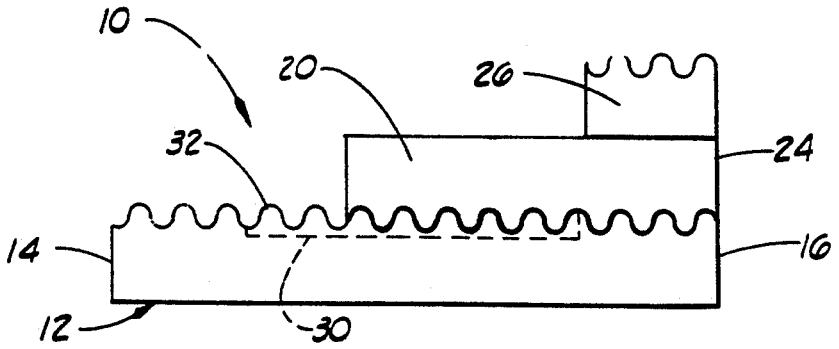
FIG. 3 is a side view of the infant positioner of FIG. 1.

With reference now to FIGS. 2 and 3, the foot member 26 is attached to the upper surface of the transverse member 24. As illustrated by FIGS. 1 and 3, the upper surface of the foot member 26 may comprise a plurality of convolutions. As best shown in FIG. 1, the foot member 26 should extend along the foot end 16 for at least the width of the torso area 30.

The infant-supporting layer 12, the lateral members 20 and 22, the transverse member 24 and the foot member 26 are all typically made of a resilient foam material. The infant-supporting layer 12, in particular, should have sufficient density to support an infant. A polyurethane foam, approximately two inches thick and convoluted on one side, is a suitable resilient foam material for the infant-supporting layer 12 and may be used for the lateral members 20 and 22, the transverse member 24 and foot member 26 as well.

A typical isolette used in a neonatal center may have inside dimensions of approximately 21 inches long and 14 inches wide with walls about two feet high. An infant positioner 10 to be used with an isolette should have dimensions to fit the mattress tray inside the particular isolette used.

The infant positioner 10 may be molded as one piece of resilient foam material. Alternatively, the infant positioner 10 may be cut in pieces from a sheet of resilient foam material and assembled according to the following steps.

First, a sheet of resilient foam material is obtained. A sheet of polyurethane foam approximately two inches thick and convoluted on one side may be used. The convolutions should be approximately two inches apart from peak to peak and should have a height of about one inch from peak to valley. A suitable polyurethane foam is the orthoposture foam contour mattress pad by Louisville Bedding Company in Louisville, Ky. or equivalent.

The infant-supporting layer 12 is cut from the sheet of foam material. If the infant positioner 10 is to be used with an isolette, the infant-supporting layer 12 is cut to fit within the isolette mattress tray, replacing the original isolette mattress.

Next the convolutions are removed from a medial portion of the infant-supporting layer 12 to provide the torso area 30. The torso area 30 should be large enough to accommodate the body of a premature infant from the shoulders to the feet. Because the size of premature babies varies, the torso area 30 may range from 4 inches by 6 inches to 8 inches by 10 inches.

The lateral members 20 and 22 and the transverse member 24 may be cut from the sheet as a single U-shaped piece or as three separate pieces. The infant-supporting layer 12 is positioned with the convoluted side and torso area 30 facing up. The sheet of material for the lateral members 20 and 22 and the transverse member 24, with the convoluted side down, is placed on the infant supporting layer 12.

As shown in FIG. 3, the convolutions of the lateral members 20 and 22 and the transverse member 24 are positioned to mesh with the convolutions of the infant-supporting layer 12. The sheet of material for the lateral members 20 and 22 and the transverse member 24 is then trimmed to the size of the infant-supporting layer 12 and to expose the torso area 30.

The lateral members 20 and 22 and the transverse member 24 are secured to the infant-supporting layer 12 with a suitable adhesive, such as Johnson & Johnson Dermocel adhesive tape. The lateral members 20 and 22 and the transverse member 24 have their non-convoluted side up as illustrated by FIGS. 1 through 3.

The foot member 26 may then be cut from the sheet of resilient material. The foot member 26, with convoluted side up, is attached to the transverse member 24 between the torso area 30 and the foot end 16.

Figure 4:
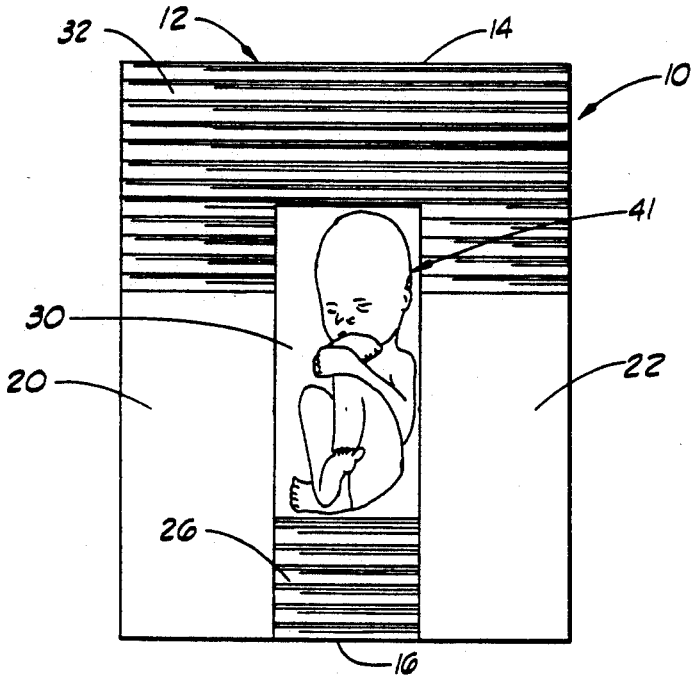
FIG. 4 is a plan view of the infant positioner of FIG. 1 supporting an infant in a supine position.
Figure 5:
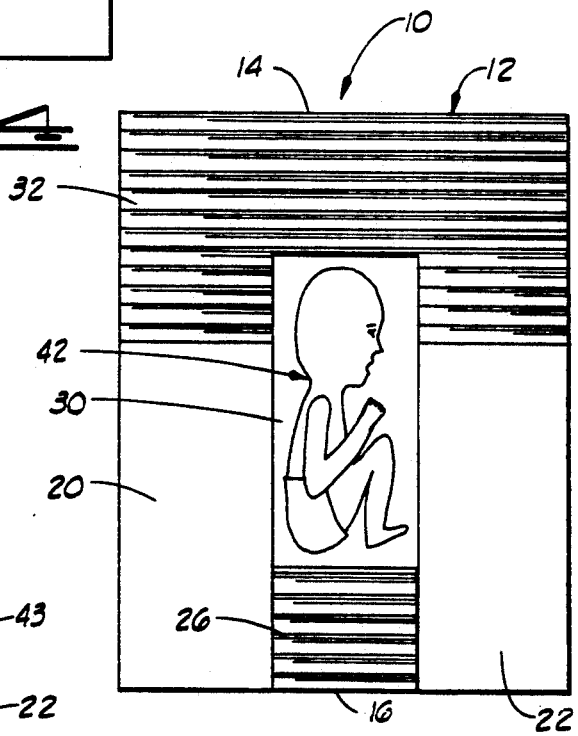
FIG. 5 is a plan view of the infant positioner of FIG. 1 supporting an infant in a side-lying position.
Figure 6:
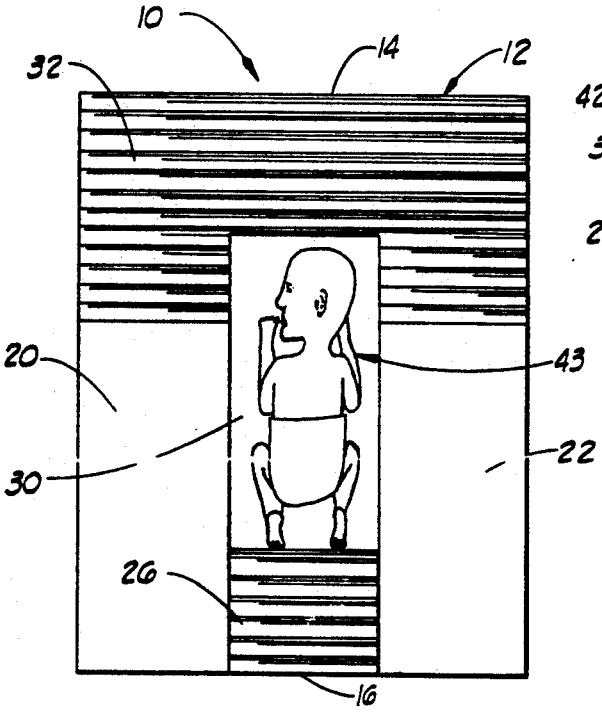
FIG. 6 is a plan view of the infant positioner of FIG. 1 supporting an infant in a prone position.

Turning now to FIGS. 4 through 6, the use of the infant positioner 10 to support an infant in various positions is described. The ability to position an infant in each of these positions is desirable because one of the positions may be preferred depending upon the infant's condition and disorders.

As illustrated by FIG. 4, the infant positioner 10 may support an infant 41 in the supine position. The supine position may be desirable where the infant has normally developed breathing and digestive systems because the infant is supported in a good position for administering care to the face and chest areas.

An infant 42 supported by the infant positioner 10 in the side-lying position is shown in FIG. 5. An infant, and particularly a premature infant, may feel more secure in a side-lying fetal position. Assuming that this position is most like an infant's position in the womb, and it is perhaps the most secure position to a premature infant. The side-lying position also allows better gravity-assisted breathing than the supine or prone positions, and may be the preferred position for a premature infant having respiratory difficulties.

As depicted in FIG. 6, the infant positioner 10 may also be used to support an infant 43 in the prone position. The prone position may be preferred for infants predisposed to coughing or vomiting. The prone position places less pressure on the air passages of the infant and helps prevent choking.

The infant positioner 10, therefore, may be used to support an infant in any of the three basic positions. It should be appreciated that, in each of the three positions, the infant substantially fills the torso area 30 of the infant positioner 10 to make the infant feel snug and secure. Although blankets, cloths or comfort pads may be used with the infant positioner 10, the infant positioner 10 alone safely contains an infant in the supine, side-lying or prone position.

Changes may be made in the combinations, operations and arrangements of the various parts and elements described herein without departing from the spirit and scope of the invention as defined in the following claims.

What is claimed is:

1. A device for positioning a premature infant, the device comprising:

an infant-supporting layer having a head end, a foot end, two lateral sides and an upper surface with a torso area in a medial portion thereof, the infant-supporting layer being adapted to support an infant in a substantially horizontal position when the infant-supporting layer is placed upon a horizontal surface;

a pair of lateral members wherein each lateral member is attached to the upper surface of the infant-supporting layer on opposing sides between the torso area and the lateral sides of the infant-supporting layer; and a transverse member attached to the upper surface of the supporting layer between the torso area and the foot end of the infant-supporting layer;

wherein the infant-supporting layer, the lateral members and the transverse member are constructed of a resilient foam material having a density for supporting and cushioning an infant and wherein the torso area is flat and the upper surface of the infant-supporting layer comprises a plurality of raised convolutions around the torso area.

2. A device for positioning a premature infant, the device comprising:

an infant-supporting layer having a head end, a foot end, two lateral sides and an upper surface with a torso area in a medial portion thereof, the infant-supporting layer being adapted to support an infant in a substantially horizontal position when the infant-supporting layer is placed upon a horizontal surface;

a pair of lateral members wherein each lateral member is attached to the upper surface of the infant-supporting layer on opposing sides between the torso area and the lateral sides of the infant-supporting layer;

a transverse member attached to the upper surface of the supporting layer between the torso area and the foot end of the infant-supporting layer; and a foot member attached to the upper surface of the transverse member between the torso area and the foot end, the foot member being constructed of a resilient foam material;

wherein the infant-supporting layer, the lateral members and the transverse member are constructed of a resilient foam material having a density for supporting and cushioning an infant and wherein the foot member has an upper surface comprising a plurality of convolutions.

3. A device for positioning a premature infant, the device comprising:

an infant-supporting layer having a head end, a foot end, two lateral sides and an upper surface with a torso area in a medial portion thereof, the infant-supporting layer being adapted to support an infant in a substantially horizontal position when the infant-supporting layer is placed upon a horizontal surface, the torso area being sized and shaped to receive the entire body of a premature infant and being recessed from the upper surface of the infant-supporting layer around the torso area;

a pair of lateral members wherein each lateral member is attached to the upper surface of the infant-supporting layer on opposing sides between the torso area and the lateral sides of the infant-supporting layer; and a transverse member attached to the upper surface of the supporting layer between the torso area and the foot end of the infant-supporting layer;

wherein the infant-supporting layer is constructed of a resilient foam material having a density for supporting an infant and wherein the lateral members and the transverse member are constructed of a resilient foam material.

4. The device of claim 3 wherein the torso area has a substantially uniform upper surface.

5. A device for positioning a premature infant, the device comprising:

an infant-supporting layer having a head end, a foot end, two lateral sides and an upper surface with a torso area in a medial portion thereof, the infant-supporting layer being adapted to support an infant in a substantially horizontal position when the infant-supporting layer is placed upon a horizontal surface, the torso area being sized and shaped to receive the entire body of a premature infant;

a pair of lateral members wherein each lateral member is attached to the upper surface of the infant-supporting layer on opposing sides between the torso area and the lateral sides of the infant-supporting layer;

a transverse member attached to the upper surface of the supporting layer between the torso area and the foot end of the infant-supporting layer; and a foot member attached to the upper surface of the transverse member between the torso area and the foot end, the foot member being constructed of a resilient foam material;

wherein the infant-supporting layer is constructed of a resilient foam material having a density for supporting an infant and wherein the lateral members and the transverse member are constructed of a resilient foam material.

6. The device of claim 5 wherein the foot member has an upper surface comprising a plurality of convolutions.

* * * * *